US006270162B1

(12) United States Patent
Jeny

(10) Patent No.: US 6,270,162 B1
(45) Date of Patent: Aug. 7, 2001

(54) CHAIR HAVING A SOLID BASE

(76) Inventor: Andy Jeny, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/465,244

(22) Filed: Dec. 14, 1999

(51) Int. Cl.[7] ..... A47C 7/00
(52) U.S. Cl. ..... 297/440.22; 297/440.1
(58) Field of Search ..... 297/440.1, 440.22, 297/445.1, 448.1

(56) References Cited

U.S. PATENT DOCUMENTS 3,259,431 * 7/1966 Gale .
5,439,269 * 8/1995 Cheng .
5,649,742 * 7/1997 Liu .
5,890,767 * 4/1999 Chang .

FOREIGN PATENT DOCUMENTS

2154868 * 9/1985 (GB) ..... 297/440.22

* cited by examiner

*Primary Examiner*—Milton Nelson, Jr.

(57) ABSTRACT

A chair includes a seat plate disposed on a base, four panels secured to the bottom of the seat plate and secured to the base for securing the seat plate on the base. The base includes a pair of bars having a middle portion secured together to form a cross-shape. Four fasteners are engaged through the bars and engaged with the panels for securing the seat plate on the base. The middle portions of the bars each has a flat recess engaged with each other for maintaining the bars at the cross-shape. Four pads are engaged on the bars and engaged between the bars and the panels.

8 Claims, 2 Drawing Sheets

CHAIR HAVING A SOLID BASE

BACKGROUND OF THE INVENTION

1. Field of the Invention

The present invention relates to a chair, and more particularly to a chair having a solid base.

2. Description of the Prior Art

Typical chairs having a base formed with one or more tubular members, comprise a seat plate directly secured on top of the base with fasteners. The tubular members of the base are bent and assembled together to form the base having four legs dependent downward therefrom. Normally, the base plate is made of wood materials and is directly secured on top of the base with screws. The wooden seat plate may be easily become loose relative to the base after use.

The present invention has arisen to mitigate and/or obviate the afore-described disadvantages of the conventional chairs.

SUMMARY OF THE INVENTION

The primary objective of the present invention is to provide a chair including a configuration for solidly securing the seat plate on the base.

In accordance with one aspect of the invention, there is provided a chair comprising a seat plate disposed on a base, four panels secured to the bottom of the seat plate, and means for securing the base to the panels and to secure the seat plate on the base.

The base includes a pair of bars having a middle portion secured together to form a cross-shape, the bars each has two apertures, the securing means includes four fasteners engaged through the apertures of the bars and engaged with the panels respectively for securing the seat plate on the base. The bars each includes two ends each having a leg dependent downward therefrom. The middle portions of the bars each includes a recess formed therein for receiving the middle portions of the respective bars and for maintaining the bars at the cross-shape. The middle portions of the bars each has a flat surface engaged with each other.

Four pads are engaged between the bars and the panels and each has a lateral opening for receiving the bar and for allowing the pads to be engaged onto the bars. The pads each includes an orifice formed therein, the base includes four apertures formed therein, the securing means includes four fasteners engaged through the apertures of the base and engaged through the orifices of the pads and engaged with the panels respectively for securing the seat plate on the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
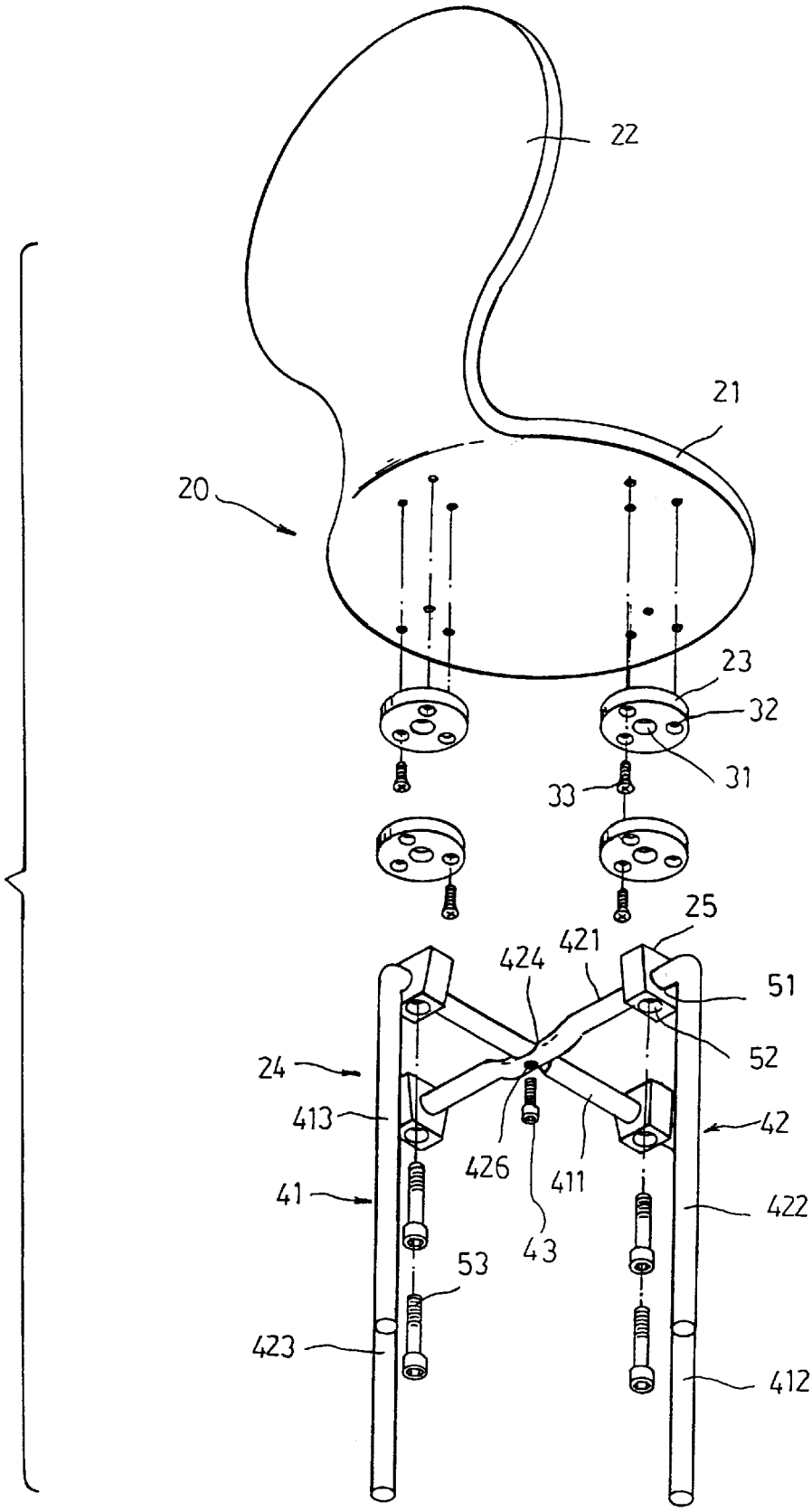
FIG. 1 is an exploded view of a chair.

Referring to the drawings, a chair in accordance with the present invention is generally designated with the reference numeral 20 and comprises a seat plate 21 disposed on and secured on top of a base 24. It is preferable that the seat plate

21 includes a seat back 22 secured to or extended from the rear portion of the seat plate 21. One or more discs or panels 23 are provided for attaching to the bottom of the seat plate 21 and includes one or more holes 32 formed therein for receiving fasteners 33 which may secure the panels 23 to the bottom of the seat plate 21. The panels 23 each includes a screw hole 31 formed therein and are preferably made of metal or the other materials having a suitable strength.

Figure 2:
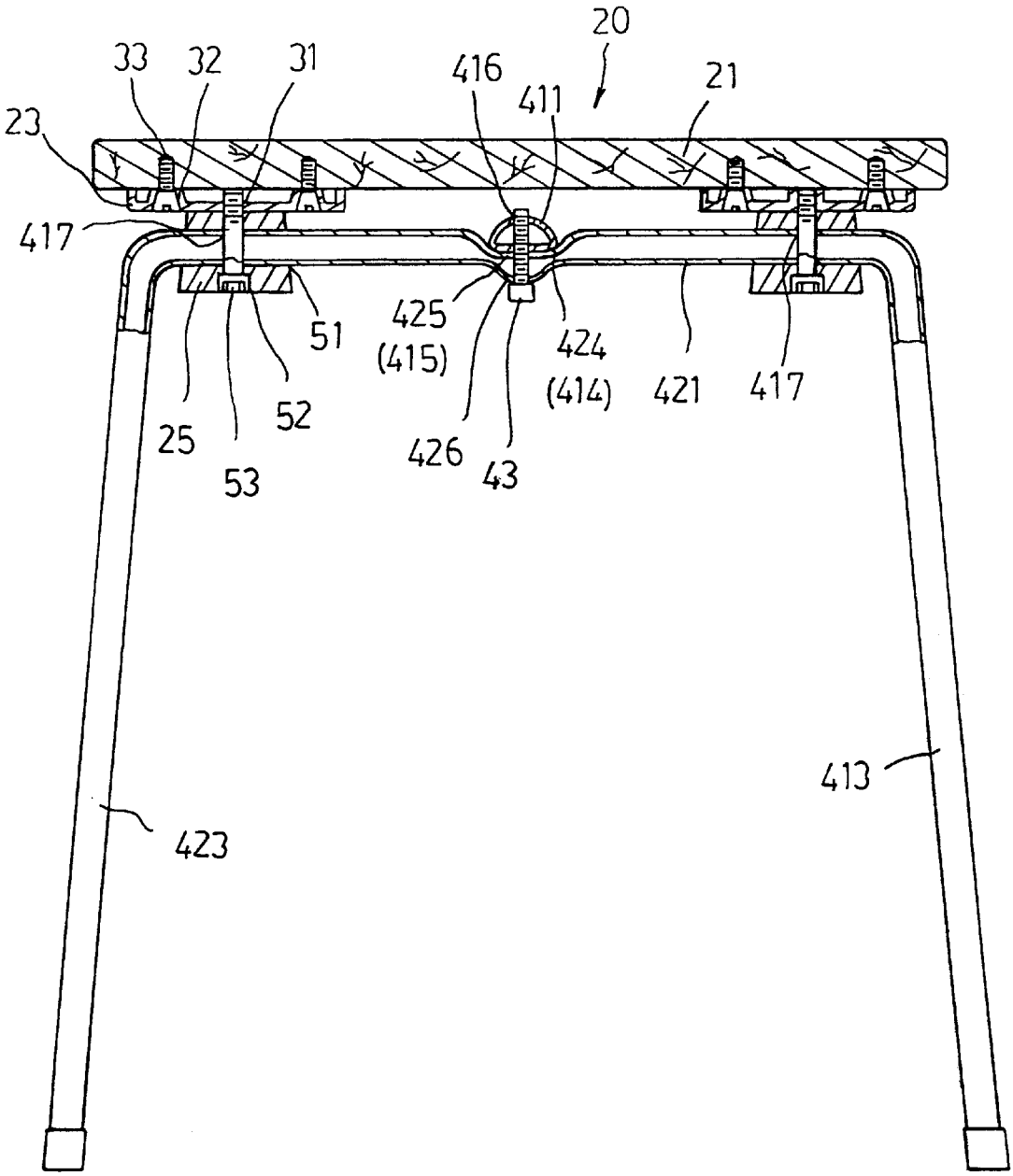
FIG. 2 is a cross sectional view of the chair.

The base 24 includes a pair of inverted U-shaped frames 41, 42 each having an upper bar 411, 421 and each having two legs 412, 413; and 422, 423 extended downward from the ends of the respective bar 411, 421. The bars 411, 421 each includes a squeezed or pressed middle portion having a recess 414, 424 formed therein (FIG. 2) and having a flat surface 415, 425 formed therein and having a hole formed therein, particularly a screw hole 416, 426 formed therein for receiving a fastener 43, such as a screw or a bolt, which may secure the frames 41, 42 together. The shapes and the sizes of the flat surfaces 415, 425 and of the recesses 414, 424 of the bars 411, 421 are determined or selected corresponding to that of the other bars 411, 421 for maintaining the bars 411, 421 and frames 41, 42 in the cross-shape and for maintaining the legs 412, 413, 422, 423 in the corners of a square. The bars 411, 421 each includes two end portions each having an aperture 417 formed therein.

Four pads 25 are provided and preferably made of rubber materials or plastic materials or metal materials or the other suitable materials. The pads 25 each includes an opening 51 laterally formed therein and having a size equals to that of the bars 411, 421 and the legs 412, 413, 422, 423 of the frames 41, 42 for allowing the pads 25 to be engaged onto the bars 411, 421 via the legs 412, 413, 422, 423. The pads 25 each includes an orifice 52 vertically formed therein and communicating with the opening 51 of the pads 25 and aligned with the apertures 417 of the bars 411, 421 for receiving fasteners 53. The fasteners 53 may engage through the orifices 52 of the pads 25 and the apertures 417 of the bars 411, 421 and may be threaded with the screw holes 31 of the panels 23 for securing the seat plate 21 on the frames 41, 42 of the base 24. The panels 23 may each include a nut secured thereon for threading with the fasteners 53 and for allowing the fasteners 53 to secure the seat plate 21 on the base 24. The fasteners 53 may also be replaced with or selected from the other fasteners, such as the rivets, fastener pins, quick-release locks etc.

The panels 23 may be solidly secured to the bottom of the seat plate 21 and include a greater area engaged with the seat plate 21 than the fasteners 53. In addition, the panels 23 may be made of metal or stronger materials such that the seat plate 21 may be solidly secured on the base 24 with the panels 23 and the fasteners 53. In addition, the frames 41, 42 form a solid and stable structure for the chair. Alternatively, a single and larger panel may be secured to the bottom of the seat plate 21 and may include four screw holes formed therein for threading with the fasteners 53 instead of the four panels 23.

Accordingly, the chair in accordance with the present invention includes a configuration for allowing the seat plate to be solidly secured to the base.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chair comprising:

a base, a seat plate provided above said base and including a bottom portion, four panels secured to said bottom portion of said seat plate, and means for securing said base to said panels and to secure said seat plate on said base, wherein said base includes a pair of bars having a middle portion secured together to form a cross-shape, said bars each includes an aperture formed therein, said securing means includes four fasteners engaged through said apertures of said bars and engaged with said panels respectively for securing said seat plate on said base.

2. The chair according to claim 1, wherein said middle portions of said bars each includes a recess formed therein for receiving said middle portions of said respective bars and for maintaining said bars at said cross-shape.

3. The chair according to claim 2, wherein said middle portions of said bars each includes a flat surface formed in said recess thereof, said flat surfaces of said bars are engaged with each other.

4. The chair according to claim 1, wherein said bars each includes two ends each having a leg dependent downward therefrom.

5. The chair according to claim 1 further comprising four pads engaged between said bars and said panels.

6. The chair according to claim 5, wherein said pads each includes an opening laterally formed therein for receiving said bar and for allowing said pads to be engaged onto said bars.

7. The chair according to claim 5, wherein said pads each includes an orifice formed therein, said fasteners are engaged through said apertures of said bars and engaged through said orifices of said pads and engaged with said panels respectively for securing said seat plate on said base.

8. A chair comprising:

a base, a seat plate provided above said base and including a bottom portion, four panels secured to said bottom portion of said seat plate, means for securing said base to said panels and to secure said seat plate on said base, and four pads engaged between said base and said panels.

* * * * *